United States Patent [19]

Nelson

[11] 4,200,254

[45] Apr. 29, 1980

[54] PANEL BASE

[76] Inventor: George Nelson, 251 Park Ave. South, New York, N.Y. 10010

[21] Appl. No.: 911,547

[22] Filed: Jun. 1, 1978

[51] Int. Cl.[2] ..... E04H 1/00

[52] U.S. Cl. ..... 248/188.8; 248/149; 52/239; 160/351

[58] Field of Search ..... 52/239, 71, 65; 160/135, 351; 248/188.8, 188.9, 188.91, 148, 149; 403/61, 59

[56] References Cited

U.S. PATENT DOCUMENTS

| | | | |
|---|---|---|---|
| 86,254 | 1/1869 | Simpkins . | |
| 1,425,072 | 8/1922 | Adams | 248/188.8 |
| 1,444,569 | 2/1923 | Starkweather . | |
| 1,668,538 | 5/1928 | Brandt . | |
| 1,898,384 | 2/1933 | Noros . | |
| 2,769,650 | 11/1956 | Larson | 403/61 |
| 2,873,987 | 2/1959 | Larson | 403/61 |
| 2,913,207 | 11/1959 | Eash | 248/148 |
| 3,008,787 | 11/1961 | Jones . | |
| 3,232,370 | 2/1966 | Jaffe . | |
| 3,309,050 | 3/1967 | Blink et al. | 248/188.2 |
| 3,583,466 | 6/1971 | Dreger | 160/351 |
| 3,630,309 | 6/1969 | Wenger . | |
| 3,718,306 | 2/1973 | Murray | 248/188.8 |
| 3,766,692 | 10/1973 | Stark et al. | 52/71 |
| 4,047,337 | 9/1977 | Bergstrom | 52/71 |
| 4,056,903 | 11/1977 | Guarnere | 52/239 X |

*Primary Examiner*—James A. Leppink
*Assistant Examiner*—Carl D. Friedman
*Attorney, Agent, or Firm*—Edward E. Dyson

[57] ABSTRACT

An apparatus for supporting a wall panel or the like including a first member operable for connection to a lower portion of a wall panel and a second member for stably engaging a ground surface. The first and second members are adjustably interconnected at juxtaposed flat surface portions wherein one of the surfaces is fashioned with a vertical slot and the other of the surfaces is provided with an arcuate slot. A pair of threaded fasteners extend through the slots and serve to clamp the surfaces in a selected vertical and angular adjustment posture so as to permit stable support for a vertical wall panel resting upon an uneven ground surface.

9 Claims, 5 Drawing Figures

22
24
26
30
32
34
36
38
40
41
42
44
46
48
50
52
54
56
64
66
70
72
74
76
78
80
82
84
5

PANEL BASE

BACKGROUND OF THE INVENTION

This invention relates to a panel support apparatus. More specifically this invention pertains to a panel support apparatus which is both horizontally and vertically adjustable so as to enable a generally vertical wall panel or the like to be securely supported upon an uneven or slightly nonplanar floor surface.

In the art of business office layout and design, increasing attention has been directed to modular space utilization within a large generally open floor area. While this concept provides a sense of openness and space, it is also desirable to be able to isolate certain work areas. In this regard free-standing panels have been designed with esthetically appealing and sound-absorbing cloth coverings. These panels are typically six to seven feet in height and are used to partially enclose or block off a desk area from casual traffic and the like.

While the floor or ground surface of modern office buildings are theoretically level, it has been found in practice that whether one encounters a concrete-base floor or steel planking, slight grades, dips or other departures from a desired planar surface are inevitably encountered. Accordingly, it has been found that in many instances free-standing panels tend to cant or tilt away from a preferred vertical posture on commercial flooring surfaces.

In the past, this problem has been at least partially alleviated by the adoption of an adjustable base member for the panel. Such adjustable base members typically entail a horizontal extending flat or shaped metal plate with leveler guides or bearing pads vertically turned upward into the remote ends of the metal plates. A threaded rod is then typically attached to a central portion of the metal plate and projects upwardly into a threaded socket within a lowermost portion of a panel. To level this type of base entails rotating the entire metal plate to adjust the horizontal position of the panel and then rotating leveler guides maintained at each end of the plate in or out to adjust the vertical inclination of the panel.

Although previously known leveling bases have received at least a degree of utilization in the art, difficulties exist in using these prior units. In this connection, it is extremely difficult and cumbersome to lift a panel section by the end-most portion and then pivot the entire base to achieve a desired degree of horizontal leveling of the panel. In this same vane, it is also cumbersome and difficult to achieve a plumb orientation of the panel by rocking the panel structure back and forth while the leveler guides or bearing pads are vertically screwed in and out on a trial and error basis. In addition the central supporting column of previously known base units typically receives a high bending moment during this adjusting process and thus is subject to forces great enough in some instances to damage the base unit. Still further, in those instances where vertical orientation is a particular problem, the end-most areas of the horizontal metal plates will be elevated at one end to such a degree that it presents a safety consideration due to the likelihood of tripping over an upwardly projecting support.

The difficulties suggested in a proceeding are not intended to be exhaustive, but rather are among many which may tend to reduce the effectiveness and user satisfaction of prior panel leveling and support units.

Other noteworthy problems may also exist; however, those presented above should be sufficient to demonstrate that adjustable supporting base members for modular wall panels appearing in the art will admit to worthwhile improvement.

OBJECTS OF THE INVENTION

It is therefore a general object of the invention to provide a novel apparatus for supporting a modular panel which will obviate or minimize difficulties of the type previously described.

It is a specific object of the invention to provide a novel apparatus for supporting a free-standing panel wherein vertical and horizontal adjustment of the unit may be facilely achieved.

It is another object of the invention to provide a novel apparatus for supporting a free-standing panel wherein portions of the unit engaging a ground surface will firmly contact the ground surface and minimize the possibility of providing a trip hazard to an inattentive passer-by.

It is still another object of the invention to provide a novel apparatus for supporting a free-standing panel wherein a base member may be securely and rigidly coupled to a wall panel.

It is a further object of the invention to provide a novel apparatus for supporting a free-standing panel which may be vertically and horizontally adjusted while maintaining a firm ground-engaging contact with an underlying flooring surface.

BRIEF SUMMARY OF THE INVENTION

A preferred embodiment of the invention which is intended to accomplish at least some of the foregoing objects entails a first member for engaging and being releasably connected to a wall panel. This member typically will entail a generally U-shaped yoke having a pair of leg portions extending upwardly to embrace lateral surface areas of the panel and a bight portion for supporting a lower-most edge of the upstanding panel. The base apparatus includes a second member connected to the first member which includes a horizontally projecting foot means extending outwardly on each side of the first member and is generally U-shaped in cross-section and downwardly extending to engage a ground surface. A first flat portion extends downwardly from the first member, and a second flat portion extends upwardly from the second member. One of said first and second flat portions is provided with a vertical slot, while the other of said first and second flat portions is provided with an arcuate slot. A pair of threaded fasteners extend through apertures within the first and second flat portions of the first and second members and through the vertical and arcuate slots respectively to permit relative vertical and pivotal adjustment of the first member with respect to the second member. Thus, a wall panel connected to the first member may be horizontally and vertically adjusted while the base or second member securely rests upon a ground surface.

THE DRAWINGS

Other objects and advantages of the present invention will become apparent from the following detailed description of a preferred embodiment thereof taken in conjunction with the accompanying drawings, wherein.

Figures 3, 4, 5:
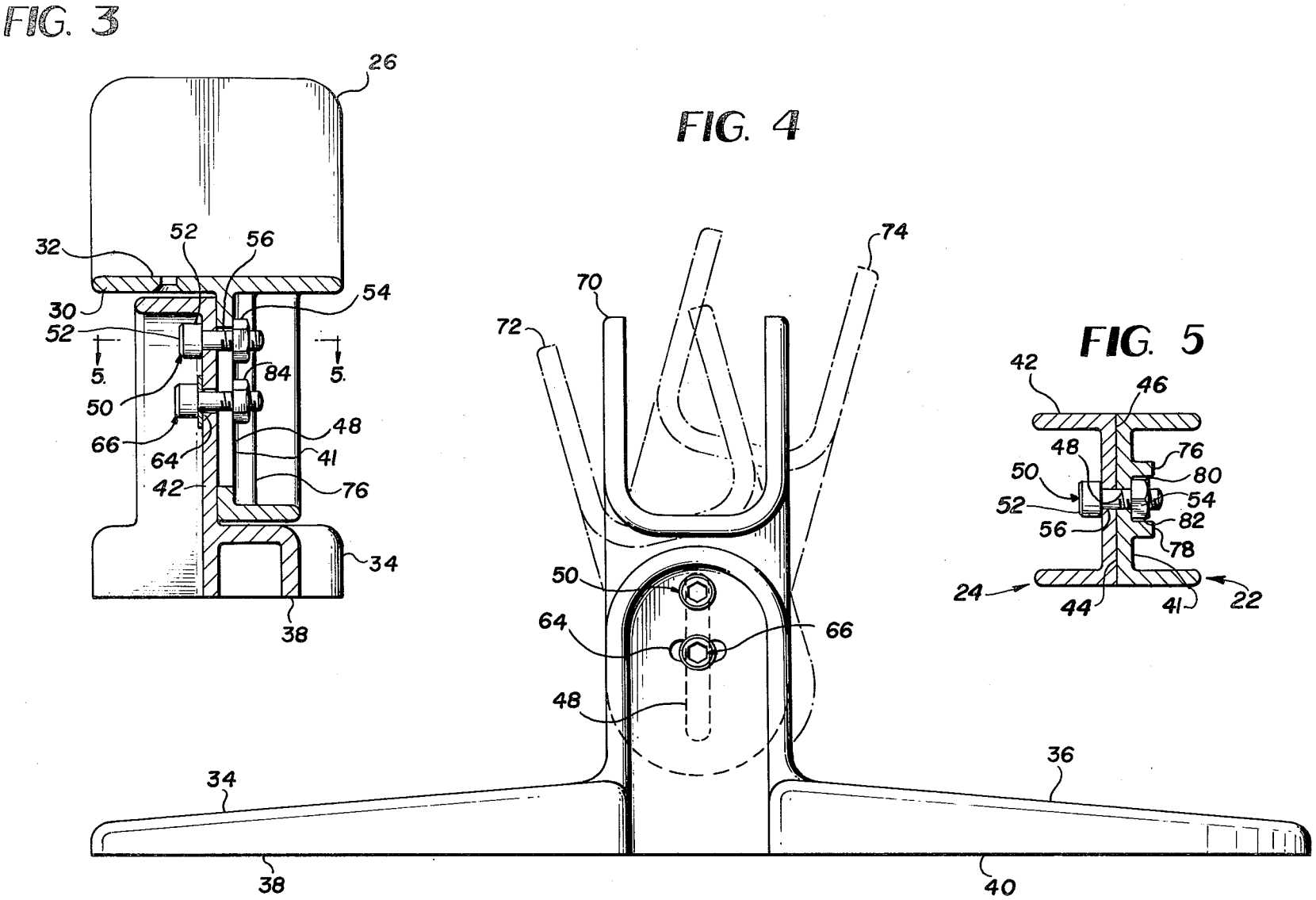
FIG. 3 is a cross-sectional view of the panel support apparatus are taken along section line 3—3 in FIG. 2.

FIG. 4 is a end elevational view of the panel support apparatus in accordance with the invention and discloses in solid lines a vertical orientation between a first panel supporting member and a second ground engaging member and in phantom lines pivotal adjustment positions wherein the first member is pivoted relative to the second member; and FIG. 5 is a cross-sectional detailed view taken along section line 5—5 in FIG. 3 and discloses a pair of mutually parallel locking channels fashioned upon one of the first and second panel support members.

DETAILED DESCRIPTION

Figure 1:
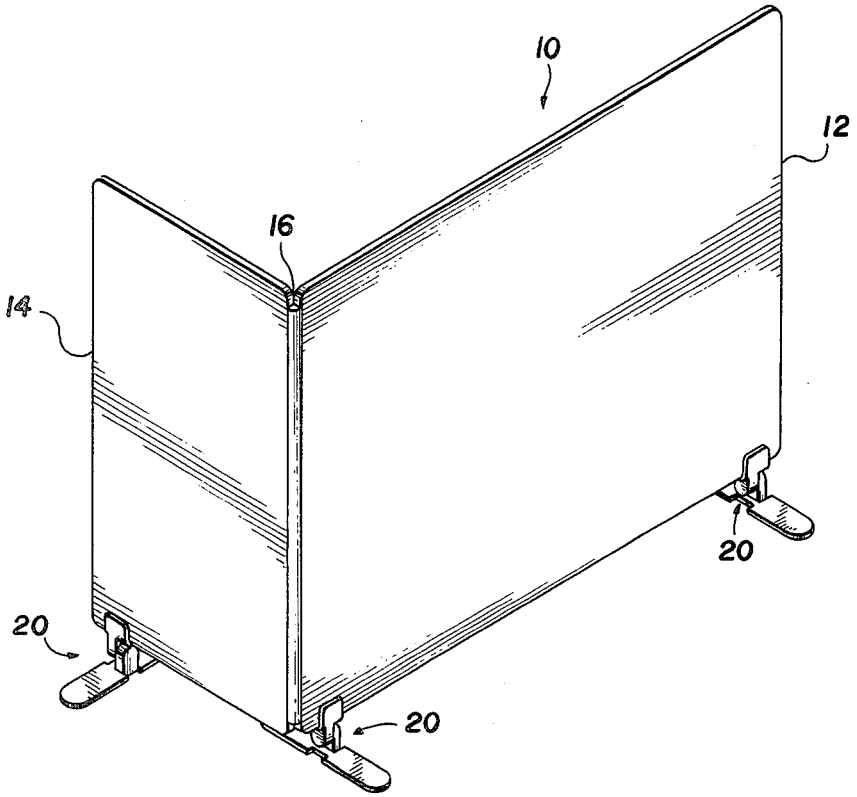
FIG. 1 is an axonometric view of an L-shaped wall panel module supported by vertically and horizontally adjustable bases in accordance with the present invention.

Referring now to the drawings and particularly to FIG. 1 thereof, there will be seen a pictorial view of a free-standing L-shaped panel assembly 10. The panel assembly 10 includes a first panel 12 and a second panel 14 which are interconnected along an abutting edge 16 to form an L-shaped panel module. These panels 12 and 14 are typically one to two inches in thickness, six or seven feet in height, and 9 to 10 feet in length. Internally the panels are fabricated with a steel or wood frame which is covered with an esthetically appealing, sound absorbing fabric surface.

The lower-most portion of the panels 12 and 14 are supported with vertically and horizontally adjustable panel support members 20 in accordance with a preferred embodiment of the invention.

Figure 2:
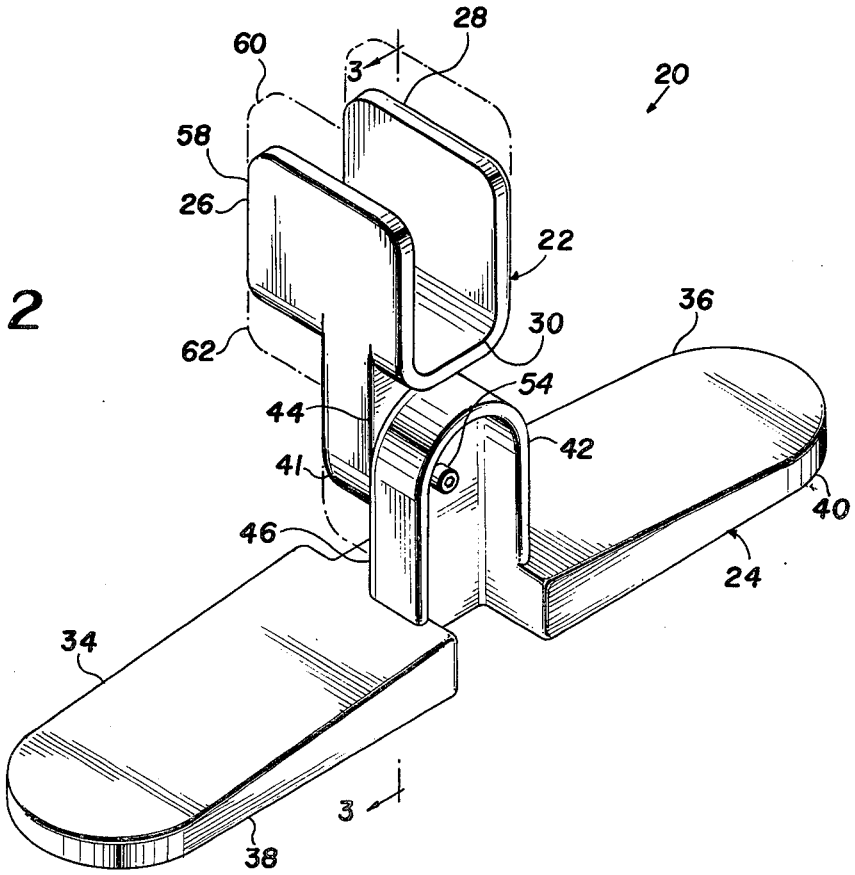
FIG. 2 is an axonometric view of a panel support apparatus in accordance with the invention.

Referring now particularly to FIG. 2 there will be seen an axonometric detail view of an adjustable panel support apparatus 20 in accordance with a preferred embodiment of the invention. More specifically the panel support apparatus includes a first panel engaging member 22 which is interconnected with a second ground contacting member 24.

The upper member 22 includes a generally U-shaped, panel engaging yoke portion having upwardly extending side members 26 and 28 suitable for lying along and internally engaging corresponding lateral surface portions of a panel to be supported. A lower-most portion of the yoke or bight 30 serves to directly underlie and support a lower-most edge surface of a panel. As seen in FIG. 3, the bight portion of the yoke may be provided with an aperture 32 to receive a threaded fastener which may be screwed directly into the frame structure of the panel to releasably connect the yoke and the panel together. Alternatively the lateral members 26 and 28 of the yoke may include apertures operable to receive threaded fasteners for securing the panel to the panel support apparatus.

The second or lower-most member 24 includes a pair of outwardly directed leg members 34 and 36. These leg members are each generally U-shaped in cross-section, note FIG. 3. The U-shaped members are downwardly oriented and present a peripheral lower-most surface 38 and 40, respectively, operable to lie directly upon and firmly engage a ground surface.

The upper yoke member 22 is interconnected to the lower foot member 24 through mutually facing flat surface members 41 and 42. The flat surface member 41 entails a downwardly projecting U-shaped element having a planar area 44. In a similar manner, the member 42 includes an upwardly extending U-shaped element having a planar area 46 directed toward and abutting against the first flat surface area 44.

As seen in FIG. 3 the first flat surface member 41 includes a generally vertical elongate slot 48 which extends from an upper portion of the member 41 to a lower portion thereof, note FIG. 4. A first threaded fastener 50 including a machine bolt 52 and nut combination 54 extends through a generally circular aperture 56 formed through the second member 42 and projects through the vertical slot 48 within the first member 41. Accordingly, as illustrated in FIG. 2, loosening of the nut 54 will permit the yoke member 22 to be vertically raised and lowered or adjusted relative to the foot member 24 from a first position 58, as depicted in solid lines of FIG. 2, to an upper position at 60 or a lower position at 62 as depicted by phantom representation in FIG. 2. This vertical adjustment once selected may be located into place by tightening the machine screw, nut combination 50.

The second planar member 42 is provided with an arcuate slot 64 extending approximately through an angle of 30 degrees. A second machine bolt and nut combination 66 extends through the arcuate slot 64 and the vertical slot 48, note FIG. 3. Accordingly, in order to adjust a wall panel such as 12 or 14 into a vertical orientation it is merely necessary to loosen the machine bolt combination 66 and cant the panel from an initial position 70 depicted in solid lines in FIG. 4 to a left inclination 72 or a right inclination 74 noted by phantom representation in FIG. 4. Once the desired vertical orientation is selected the machine bolt combination 66 is tightened to rigidly clamp the interconnecting structure in a selected position.

Referring now to FIG. 5 there will be seen a detailed cross-sectional view taken along section line 5—5 in FIG. 3 wherein the first flat element 44 of the upper member 22 is shown in abutting engagement with the flat portion 46 of the lower member 24. The machine bolt combination 50 projects through aperture 56 and vertical slot 48. First 76 and second 78 mutually parallel and vertically extending guide rails extend along the vertical slot from an uppermost portion of the member 41 to a lowermost portion thereof, note FIG. 3. The internal wall surfaces of the rails 76 and 78 are dimensioned to be juxtaposed to but slightly spaced from opposing land surfaces 80 and 82 of the nut 54. Accordingly the interior portion of the rails 76 and 78 serve to prevent rotation of the nut 54 during an adjusting operation. In a similar vein the nut portion 84 of the machine bolt and nut combination 66 is prevented from rotation during adjustment.

In order to adjust the subject base structure, all that is required is to insert an allen wrench into the heads (note the hexagonal recesses depicted in FIG. 4) of the machine bolts 50 and 66 to loosen both machine bolts, position the horizontal elevation of the unit and then tighten the machine bolt 50. Once this elevation is secure the vertical inclination of the panel is adjusted by canting the panel into plumb and then tightening the machine bolt combination 66.

ADVANTAGES OF THE INVENTION

In describing an apparatus for adjustably supporting a wall panel or the like in accordance with a preferred embodiment of the invention, those skilled in the art will recognize several advantages which singularly distinguish the invention from previously known apparatus.

A particular advantage of the invention is the provision of the combination of an elongate vertical slot in combination with an arcuate slot in the upper and lower support member, whereby vertical and pivotal adjustment may be facilely accomplished.

The subject invention further eliminates utilization of ground engaging pads which were previously positioned at the extremities of downwardly extending foot members. The elimination of these pads enables the unit to exhibit a more secure footing which is distributed over a larger ground surface area without being elevated into the air, which had previously presented a safety hazard.

The U-shaped yoke assembly provides secure and rigid interconnection between the adjustable base apertures and a panel to be supported thereby and thus eliminates any tendency of the unit to wabble or tip in the event of a casual bump or the like.

Still further the adjustment interconnection includes a pair of generally vertical rails which serve to engage flats upon nut portions of threaded fasteners so as to facilitate both vertical and pivotal adjustment of the units.

In describing the invention, reference has been made to a preferred embodiment. Those skilled in the art, however, and familiar with the disclosure of the subject invention, may recognize additions, deletions, modifications, substitutions and/or other changes which will fall within the purview of the subject invention as defined in the following claims.

What is claimed is:

1. An apparatus for supporting a wall panel or the like, said apparatus comprising:
   (a) first member means operable for engaging and releasably connecting to a wall panel;
   (b) second member means connected to said first member means and including
      (i) foot means for engaging a ground surface and
      (ii) first means interconnecting said first member means and said second member means for permitting relative vertical and pivotal adjustment between said first and second member means and thus vertical and pivotal adjustment of a wall panel supported thereby with respect to a ground surface, said first means comprising:
      (A) a first generally flat member fashioned upon said first member means;
      (B) a second generally flat member fashioned upon said second member means; and
      (C) second means for adjustably interconnecting said first generally flat member and said second generally flat member at any one of a plurality of relative vertical and pivotal adjustment positions, said second means comprising:
         (I) vertical slot means fashioned through one of said first and second generally flat members;
         (II) first aperture means extending through the other of said first and second generally flat members and having an axis intersecting the centerline of said vertical slot means; and
         (III) first fastener means extending through said first aperture means and said vertical slot means for selectively interconnecting said first and second generally flat members in any one of a plurality of relative vertical adjustment positions.

2. An apparatus for supporting a wall panel or the like, said apparatus comprising:
   (a) first member means operable for engaging and releasably connecting to a wall panel, said first member means comprising:
      (i) a generally U-shaped yoke means for receiving and cradeling in supporting engagement a lower edge portion of a wall panel and
      (ii) means for releasably interconnecting said yoke means with the panel for selectively securing said yoke means to the panel;
   (b) second member means connected to said first member means, said second member means including foot means for engaging a ground surface; and
   (c) means interconnecting said first member means and said second member means for permitting relative vertical and pivotal adjustment between said first and second member means and thus vertical and pivotal adjustment of a wall panel supported thereby with respect to a ground surface.

3. An apparatus for supporting a wall panel or the line as defined in claim 2 wherein said second member foot means comprises:
   a pair of generally U-shaped members directed downwardly and outwardly from a central portion of said second member means.

4. An apparatus for supporting a wall panel or the like as defined in claim 3 wherein:
   said first member means includes a first member having a generally flat surface downwardly projecting with respect to said yoke means;
   said central portion of said second member means includes a second member having a generally flat surface upwardly projecting with respect to said pair of generally U-shaped foot members and being dimensioned to engage with said flat surface of said first member; and
   said means interconnecting said first member means and said second member means comprise means for adjustably interconnecting said first member flat surface and said second member flat surface at any one of a plurality of relative vertical and pivotal adjustment positions.

5. An apparatus for supporting a wall panel or the like as defined in claim 4 wherein said means for adjustably interconnecting comprise:
   vertical slot means fashioned through one of said first and second flat member means;
   first aperture means extending through the other of said first and second flat member means and having an axis intersecting the centerline of said vertical slot means; and
   first fastener means extending through said first aperture means and said vertical slot means for selectively interconnecting said first and second flat members in any one of a plurality of relative vertical adjustment positions.

6. An apparatus for supporting a wall panel and or the like as defined in claim 5 wherein said means for adjustably interconnecting further comprises:
   second aperture means extending through said one of said first and second flat member means;
   arcuate slot means fashioned through the other of said first and second flat member means and in vertical alignment with said second aperture means; and
   second fastener means extending through said second aperture means and said arcuate slot means for selectively interconnecting said first and second flat members in any one of a plurality of relative pivotal adjustment positions.

7. An apparatus for supporting a wall panel or the like as defined in claim 6 wherein said first and second fastener means each comprise:

(a) bolt and nut combinations wherein the nuts have at least one pair of opposing flat lateral faces and (b) a pair of mutually parallel rail means vertically extending upon one of said first and second flat members for receiving there between the flat surfaces of the nut portions of said first and second fastener means and being laterally dimensioned to prevent rotation of said nut portions therebetween.

8. An apparatus for supporting a wall panel or the like, said apparatus comprising:

(a) first member means operable for engaging and releasably connecting to a wall panel;

(b) second member means connected to said first member means, said second member means including foot means for engaging a ground surface; and (c) third means interconnecting said first member means and said second member means for permitting relative vertical and pivotal adjustment between said first and second member means and thus vertical and pivotal adjustment of a wall panel supported thereby with respect to a ground surface, said third means comprising:

(i) a first generally flat member fashioned upon said first member means;

(ii) a second generally flat member fashioned upon said second member means; and (iii) fourth means for adjustably interconnecting said first flat member and said second flat member at any one of a plurality of relative vertical and pivotal adjustment positions, said fourth means comprising:

(A) vertical slot means fashioned through one of said first and second flat members;

(B) first aperture means extending through the other of said first and second flat members and having an axis intersecting the centerline of said vertical slot means;

(C) first fastener means extending through said first aperture means and said second slot means for selectively interconnecting said first and second flat members in any one of a plurality of relative vertical adjustment positions;

(D) second aperture means through said one of said first and second flat members;

(E) arcuate slot means fashioned through the other of said first and second flat members and in vertical alignment with said second aperture means; and (F) second fastener means extending through said second aperture means and said arcuate slot means for selectively interconnecting said first and second flat members in any one of a plurality of relative pivotal adjustment positions.

9. An apparatus for supporting a wall panel or the like as defined in claim 8 wherein said first and second fastener means each comprises:

(a) bolt and nut combinations wherein the nuts have at least one pair of opposing flat lateral faces and (b) a pair of mutually parallel rail means vertically extending upon one of said first and second flat members for receiving there between the flat surfaces of the nut portions of said first and second fastener means and being laterally dimensioned to prevent rotation of said nut portions therebetween.

* * * * *